US005724958A

United States Patent [19]

Farnworth et al.

[11] Patent Number: 5,724,958

[45] Date of Patent: Mar. 10, 1998

[54] BREATHING HOOD

[75] Inventors: Brian Farnworth, Delta; Scott Howard Yule, Burnaby, both of Canada

[73] Assignee: M.E.T.A. Research Inc., Richmond, Canada

[21] Appl. No.: 654,422

[22] Filed: May 28, 1996

[51] Int. Cl.[6] ..... A62B 17/00

[52] U.S. Cl. ..... 128/201.23; 128/200.24; 128/200.29; 128/201.27

[58] Field of Search ..... 128/201.22, 201.23, 128/201.24, 201.25, 201.27, 205.25, 205.27, 205.28, 205.29, 206.11, 206.12, 206.15, 206.19, 206.28

[56] References Cited

U.S. PATENT DOCUMENTS

| | | | |
|---|---|---|---|
| 896,447 | 8/1908 | Hall et al. | 128/201.27 |
| 4,589,408 | 5/1986 | Singer | 128/201.25 |
| 5,133,344 | 7/1992 | Jurrius et al. | 128/201.23 |
| 5,226,409 | 7/1993 | Bower et al. | 128/201.23 |

*Primary Examiner*—Vincent Millin
*Assistant Examiner*—Robert N. Wieland
*Attorney, Agent, or Firm*—C. A. Rowley

[57] ABSTRACT

A breathing apparatus for survival gear is provided by a head receiving hood that is sealed over the head of the user and has sufficient volume to provide breathing air for at least a selected period of time while submerged and is made of a material that prevents the ingress of liquid water while being permeable to the flow of gasses therethrough whereby the supply of oxygen in the hood may be replenished and the carbon dioxide concentration reduced. A suitable waterproof transparent window is formed in the hood in the position which permits the wearer to see out of the hood and a gas passage spacer pad prevents the hood from collapsing into the breathing apertures of the user and provides passages communicating with the inside of the hood remote from the breathing passage.

20 Claims, 3 Drawing Sheets

BREATHING HOOD

FIELD OF INVENTION

The present invention relates to a breathing apparatus, more particularly, to a breathing hood.

BACKGROUND OF THE INVENTION

In a number of different emergency situations, the person facing the emergency may find himself submerged in water and required to swim underwater to save himself. Such situations are common where a boat is capsized or helicopter is ditched, for example, over the ocean or other large body of water. To facilitate survival, three main problems must be dealt with, namely, vision, as it is difficult to see under water and many people are reluctant to open their eyes when they are in direct contact with the water; time, since the air supply, i.e. the length of time a person can hold his breath generally is less than about a minute; and the third, the shock of cold water, assuming the submergence is in cold water which causes gasping reflexes even further reducing the breath holding time.

The existing solution to these problems may be categorized into two main types.

1. compressed air cylinders or oxygen cylinders of the scuba type with mouth piece, nose clip, etc.; and
2. a breathing apparatus consisting of a container into which the user exhales and then inhales the same air. The simplest versions are totally passive and may extend breathing times by perhaps a minute. The more sophisticated versions incorporate a source of oxygen and a chemical scrubber to remove carbon dioxide and can provide in the order of 10 minutes breathing time. Again, this system requires a scuba type mouth piece and nose clip.

Obviously, the existing systems are of limited effectiveness and have, amongst others, the following disadvantages:

1. where mouth pieces and scuba gear are required, the units are expensive
2. the user must be trained in how to actuate the device to initiate breathing at the right time and to clear the mouth piece of water, all of which may be difficult without continued practice
3. the nose clip must be installed
4. the mouth piece is put in place before the actual accident. There is a danger it will be dislodged and/or cause injury on impact.

Neither of the two existing solutions address the question of vision.

BRIEF DESCRIPTION OF THE PRESENT INVENTION

It is an object of the present invention to provide a simplified breathing apparatus to protect the user and provide an air supply.

Broadly, the present invention relates to a breathing hood having a capacity to receive a user's head and provide a volume therein in the form of an air space to provide an air supply for the user to breathe for a preselected period of time, said hood including means to substantially prevent the ingress of liquid water there into when said hood is submerged, means for permitting transfer of gasses including oxygen and carbon dioxide between inside of said hood and outside air when said hood is exposed to outside air, passage means in said hood to facilitate movement of air to breathing apertures of said user from areas inside said hood remote from said breathing apertures and a transparent waterproof window formed in said hood in position to permit said user to see out of said hood.

Preferably, said means to permit transfer of gasses comprises a fabric from which said hood is made, said fabric having a porosity so that gasses including oxygen and carbon dioxide are transmitted from one side thereof to the other while substantially preventing transmission of liquid water.

Preferably, said means to permit transfer of gasses will permit transfer of sufficient gases when exposed to outside air to ensure the concentration of oxygen within said hood does not drop to an unsafe level.

Preferably, said air passage means comprises a face pad spacing said hood away from said breathing apertures of said user.

Preferably, said face pad has passages therethrough leading from said breathing apertures to said area of said hood remote from said breathing area.

Preferably, the area of said means for permitting transfer of gases will be at least 0.3 $m^2$.

Preferably, said passage means will include a scrubber means to reduce the carbon dioxide content of the gas delivered to the breathing cavity via said passage means.

Preferably, said hood will further include means to connect an oxygen cylinder to the interior thereof.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
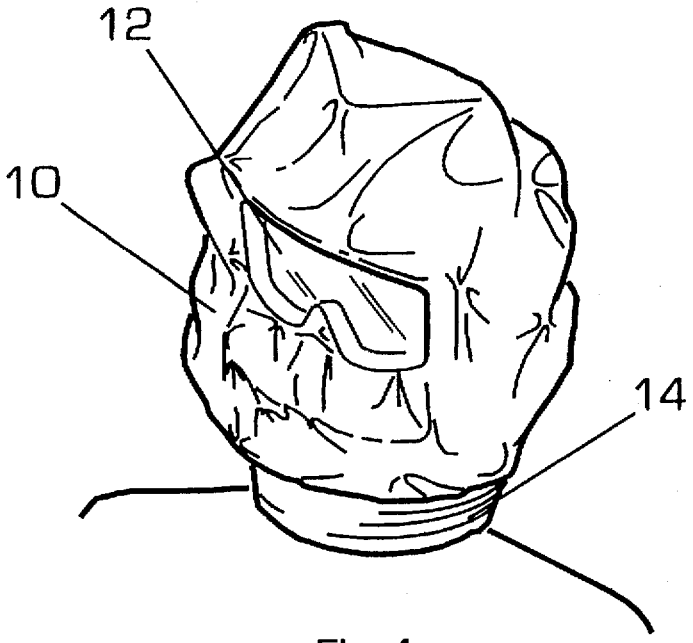
FIG. 1 is an isometric view of a hood constructed in accordance with the present invention in position on the head of a user.

As shown in FIG. 1, the hood structure 10 of the present invention includes window 12 formed in the illustrated arrangement by a set of goggles or the like to which the fabric of the hood is secured around the whole periphery so that the window section 12 does not provide a leakage area for water to penetrate into the hood 10.

The neck portion of the hood is preferably provided with a seal 14 made of suitable latex or some other material that seals around the neck of the user to prevent water from entering the hood.

In the illustrated arrangement, the whole hood 10, with the exception of the window 12 and seal 14, is preferably made from a suitable liquid impermeable, gas permeable microporous material or fabric such as the material sold under the trademark Gore-tex® by W. L. Gore and Associate or a similar product such as Ventile cotton sold by Thomas Mason Inc. (UK).

The important feature is that the material from which the hood 10 is produced does not permit the ingress of liquid water into the interior of the hood yet has sufficiently permeability to gasses including oxygen and carbon dioxide so that the oxygen is replaced within the hood as it is depleted by breathing and the exhaled carbon dioxide migrates out through the material or fabric of the hood.

In effect, the hood forms a breathing bag-like arrangement in which the head is contained and which traps a sufficient volume of air in the hood surrounding the head to meet the user's breathing requirements for a selected period of time, for example, about a minute. Preferably, the volume of air trapped in the hood 10 will be sufficient to last for two minutes while the whole hood is submerged. When the hood is above the water and is exposed to ambient air the breathing feature of the hood material permits replenishing of the oxygen as it is consumed by passing through the fabric of the hood 10.

Figure 3:
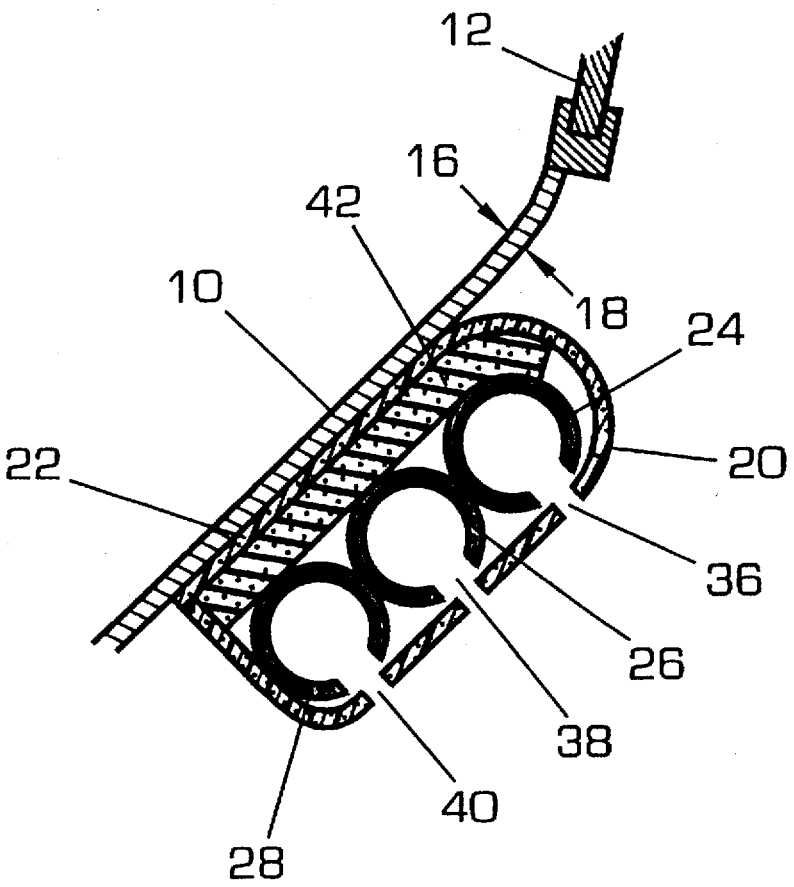
FIG. 3 is a section of a line 3—3 of FIG. 2 but with the hood fabric in position.

The breathability of the material 10 as indicated by the arrows 16 and 18 in FIG. 3 facilitates the replacement of the oxygen depleted on breathing by ingress of oxygen into the interior of the hood as indicated by the arrow 16 while the increased concentration of carbon dioxide within the hood results in carbon dioxide migrating through the material of the hood 10 and into the air to ensure that the concentration of carbon dioxide within the hood is not so large as to be unacceptable for breathing.

It is estimated that with a 0.3 $m^2$ area of the fabric 10 made of Gore-tex® and the hood exposed to the ambient atmosphere outside, the oxygen concentration will fall within the hood from about 20 to 19% and the carbon dioxide will build to about 1% which are acceptable levels for even long term exposure and certainly, will not result in difficulty wearing the hood for periods of up to about an hour.

There is a possibility of the material of the hood collapsing around the mouth and nose via external pressure, i.e. material of the hood collapsing around the breathing apertures of the user and preventing respiration of the majority of the volume of the hood. To ensure that this does not happen, a spacing device 20 is mounted within the hood immediately below window 12 in position to bridge the mouth and/or nose of the user. Preferably, the spacer 20 will be formed from a casing of open celled foam 22 which includes in the illustrated arrangement three perforated tubes 24, 26 and 28 which extend from the spacer 20 circumferentially around the hood 10 and terminate in staggered outlets 30, 32 and 34 on opposite sides of the head, i.e. of about ear level and forward therefrom.

Passages 36, 38 and 40 open through the casing 22 in the vicinity of the mouth and nose of the user and thus, provide communication along the tubes 24, 26 and 28 from their open ends 30, 32 and 34 and perforations (not shown) along their length to their corresponding apertures 36, 38 and 40 to deliver air to the breathing orifices of the user.

In the illustrated arrangement, the tubes are mounted on a resilient backing element 22 that preferably is formed from a close celled foam.

The whole structure 20 provides a spacer pad to space the mouth and nose areas of the user from the fabric hood 10.

Figure 2:
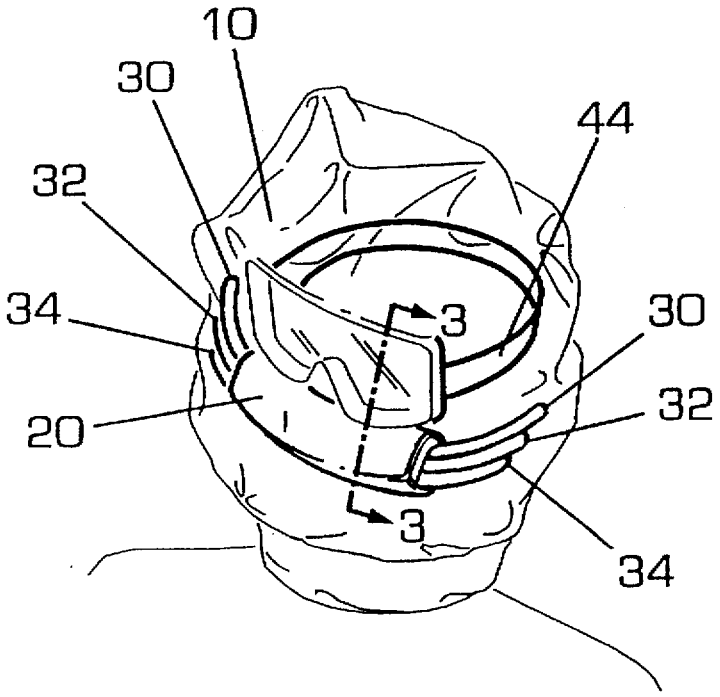
FIG. 2 is a view similar to FIG. 1 but with part of the fabric of the hood removed to show the breathing tubes and eye protection portions of the present invention.

Turning back to FIG. 2, preferably, a hood strap 44 will be provided to hold the window section or goggles 12 in proper relationship with the eyes which also ensures that the spacer 20 is properly positioned relative to the nose and mouth.

In operation, the user dons the hood shortly before ditching into the ocean and seals the hood around the neck using the neck seal 14. With the hood in position, the user may breathe normally while he is in the air atmosphere and if forced underwater upon capsizing or sinking of the helicopter or the like, the user may breathe the air contained with the hood 10 during the time of submergence. The volume of free space available within the hood 10 in excess of that required to contain the head of the user will preferably be sufficient to permit the user to breathe reasonably normally for a short period.

Figure 4:
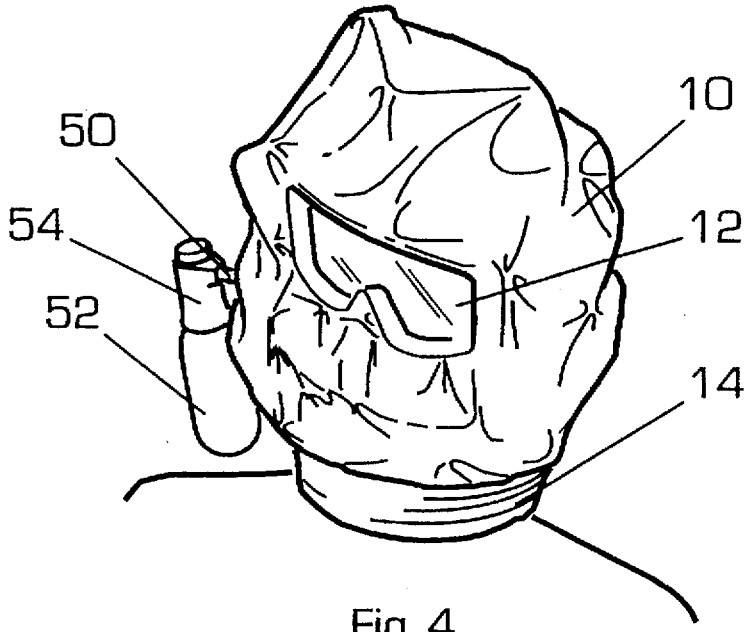
FIG. 4 is a view similar to FIG. 1 but includes a source of oxygen

Also, if desired, the interior of the hood may be connected via a suitable coupling 50 to a source of oxygen 52 to lead oxygen from the regulator 54 into the hood 10 and thereby further extend the breathing time of the user while submerged (see FIG. 4). When a separate oxygen supply is used, the oxygen content within the hood is at least at the required level and thus, it is primarily build up of carbon dioxide that is of concern for venting through the hood.

Figure 5:
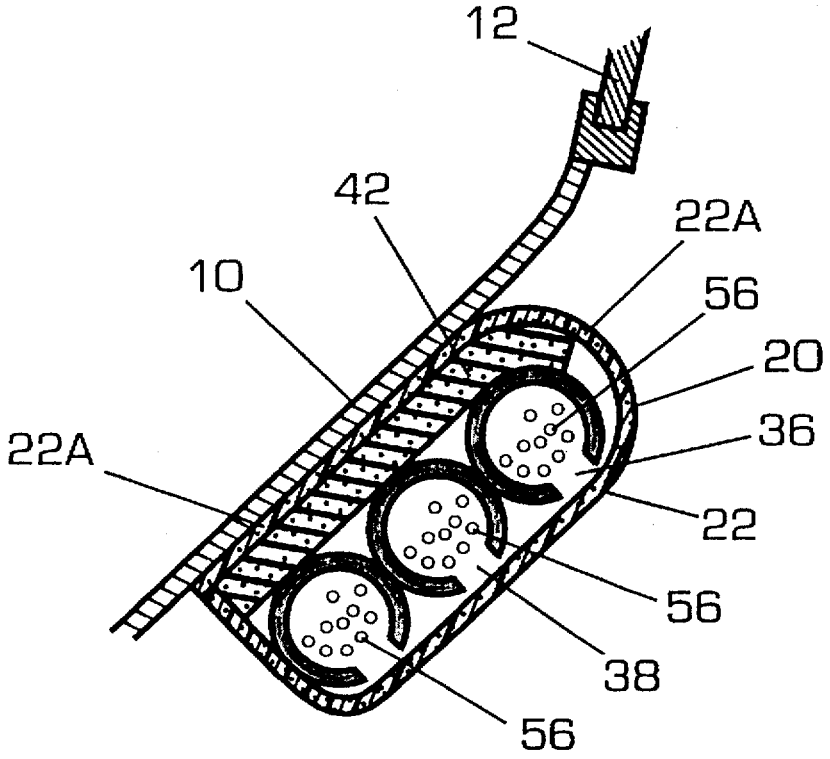
FIG. 5 is a view similar to FIG. 3 but modified to include a gas scrubber in the passages.

If desired, a suitable chemical scrubber as indicated at 56 may be installed within the tubes 24, 26 and 28 or spacer 20 and through which the air passing through the outlets 36, 38 and 40 must pass before being breathed by the user. The scrubber is effective to reduce the carbon dioxide content of the gas passing to the apertures 36, 38 and 40 in the robes 24, 26 and 28. In this arrangement the casing 22 is formed of a filter material indicated a filter paper 22A that permits the passage of gases while retaining the scrubber 56 and the apertures 36, 38 and 40 therefore do not extend through the filter paper casing 22A (see FIG. 5).

Having described the invention, modifications will be evident to those skilled in the art without departing from the scope of the invention as defined in the appended claims.

We claim:

1. A breathing hood having a capacity to receive a user's head and provide a volume therein in the form of an air space to provide an air supply for the user to breathe for a preselected period of time, said hood including means to substantially prevent the ingress of liquid water there into when submerged, means for permitting transfer of gasses including oxygen and carbon dioxide between inside of said hood and outside air, passage means in said hood to facilitate movement of air to breathing apertures of said user from areas of said hood remote from said breathing apertures and a transparent waterproof window formed in said hood in position to permit said user to see out of said hood.

2. A breathing hood as defined in claim 1 wherein said means to permit transfer of gasses comprises a permeable fabric from which said hood is made, said fabric transmitting gasses including oxygen and carbon dioxide from one side thereof to the other while substantially preventing transmission of liquid water.

3. A breathing hood as defined in claim 1 wherein said means for permitting transfer of gasses permits transfer of sufficient gases when exposed to outside air to ensure the concentration of oxygen within said hood does not drop to unsafe level.

4. A breathing hood as defined in claim 2 wherein said means for permitting transfer of gasses permits transfer of sufficient gases when exposed to outside air to ensure the concentration of oxygen within said hood does not drop to unsafe level.

5. A breathing hood as defined in claim 1 wherein said air passage means comprises a face pad spacing said hood away from said breathing apertures of said user.

6. A breathing hood as defined in claim 2 wherein said air passage means comprises a face pad spacing said hood away from said breathing apertures of said user.

7. A breathing hood as defined in claim 3 wherein said air passage means comprises a face pad spacing said hood away from said breathing apertures of said user.

8. A breathing hood as defined in claim 4 wherein said air passage means comprises a face pad spacing said hood away from said breathing apertures of said user.

9. A breathing hood as defined in claim 5 wherein said face pad has passages therethrough leading from said breathing apertures to said area of said hood remote from said breathing area.

10. A breathing hood as defined in claim 6 wherein said face pad has passages therethrough leading from said breathing apertures to said area of said hood remote from said breathing area.

11. A breathing hood as defined in claim 7 wherein said face pad has passages therethrough leading from said breathing apertures to said area of said hood remote from said breathing area.

12. A breathing hood as defined in claim 8 wherein said face pad has passages therethrough leading from said breathing apertures to said area of said hood remote from said breathing area.

13. A breathing hood as defined in claim 2 wherein the area of said means for permitting transfer of gases will be at least 0.3 $m^2$.

14. A breathing hood as defined in claim 2 wherein the area of said means for permitting transfer of gases will be at least 0.3 $m^2$.

15. A breathing hood as defined in claim 4 wherein the area of said means for permitting transfer of gases will be at least 0.3 $m^2$.

16. A breathing hood as defined in claim 6 wherein the area of said means for permitting transfer of gases will be at least 0.3 $m^2$.

17. A breathing hood as defined in claim 8 wherein the area of said means for permitting transfer of gases will be at least 0.3 $m^2$.

18. A breathing hood as defined in claim 1 wherein said passage means includes a scrubber means to reduce the carbon dioxide content of the gas delivered to the breathing cavity via said passage means.

19. A breathing hood as defined in claim 1 wherein said hood further includes means to connect an oxygen cylinder to the interior thereof.

20. A breathing hood as defined in claim 2 wherein said hood further includes means to connect an oxygen cylinder to the interior thereof.

* * * * *